US006354554B1

(12) United States Patent
Hollenbeck

(10) Patent No.: US 6,354,554 B1
(45) Date of Patent: Mar. 12, 2002

(54) BEACH UMBRELLA SUPPORT STAND

(76) Inventor: Evert Hollenbeck, 1150 Yesica Ann Cir. A-104, Naples, FL (US) 34110

( * ) Notice: Subject to any disclaimer, the term of this patent is extended or adjusted under 35 U.S.C. 154(b) by 0 days.

(21) Appl. No.: 09/522,810

(22) Filed: Mar. 10, 2000

Related U.S. Application Data

(60) Provisional application No. 60/123,567, filed on Mar. 10, 1999.

(51) Int. Cl.[7] ..... F16M 13/00

(52) U.S. Cl. ..... 248/530; 248/156

(58) Field of Search ..... 248/523, 530, 248/533, 156, 519, 541

(56) References Cited

U.S. PATENT DOCUMENTS 1,328,537 A * 1/1920 Neuman
2,617,617 A * 11/1952 Krastel et al.
2,630,287 A * 3/1953 Trogdon
3,823,785 A * 7/1974 Toliver
4,310,989 A * 1/1982 Shannon, Jr.
4,515,195 A * 5/1985 Gladstein
4,753,411 A * 6/1988 Lechner et al.
5,207,406 A * 5/1993 Stine et al.
5,271,196 A * 12/1993 Fanti
5,417,166 A * 5/1995 Credle, Sr. ..... 248/156 X
5,711,331 A * 1/1998 Harris

* cited by examiner

*Primary Examiner*—Ramon O. Ramirez
*Assistant Examiner*—Korie H. Chan
(74) *Attorney, Agent, or Firm*—William E. Noonan

(57) ABSTRACT

A support stand for a beach umbrella includes a generally planar platform having an opening formed therethrough. A clamp is carried by an upper surface of the platform. The clamp includes an opening that corresponds in size and shape to the opening in the platform. The clamp is opened to introduce an umbrella support member through the opening in the platform. The clamp is then closed to interengage the umbrella support member and fasten the umbrella to the stand. The platform is inserted beneath the sand and an umbrella is inserted through the platform and interengaged by the clamp to anchor the umbrella in place in the sand.

20 Claims, 7 Drawing Sheets

BEACH UMBRELLA SUPPORT STAND

This application claims benefit of Prov. No. 60/123,567 filed Mar. 10, 1999.

FIELD OF THE INVENTION

This invention relates to a beach umbrella support stand and, more particularly, to an apparatus that enables the user to anchor a beach umbrella quickly, conveniently and securely in the sand.

BACKGROUND OF THE INVENTION

A variety of devices are known for anchoring a beach umbrella in the sand. A number of these feature a tubular holder employing a spike or corkscrew structure that is screwed, pushed or otherwise inserted into the sand to hold the umbrella in place. Planting such anchoring systems typically requires considerable physical exertion. Moreover, these devices usually anchor the umbrella rather poorly. Strong winds or shifting sands are apt to dislodge the anchor and topple or otherwise disrupt the umbrella.

Certain known umbrella support stands utilize a container filled with sand to hold the beach umbrella in place. See Urgola U.S. Pat. No. 5,427,346 and Stine U.S. Pat. No. 5,207,406. These stands are rather bulky and inconvenient to transport to and from the beach. Furthermore, they utilize a fairly intricate construction. In order to weigh down the container, sand must be shoveled or otherwise lifted and deposited into the container. As a result, anchoring the umbrella is normally a relatively arduous and time consuming task. When the umbrella and stand are disassembled, sand must be cleaned out of the container.

SUMMARY OF INVENTION

It is therefore an object of the present invention to provide an improved stand for securely anchoring and supporting a beach umbrella in the sand.

It is a further object of this invention to provide a beach umbrella support stand that enables a standard beach umbrella to be set up and broken down quickly, conveniently and with a minimal amount of physical effort.

It is a further object of this invention to provide a beach umbrella support stand that is compact, lightweight and extremely easy to transport to and from the beach.

It is a further object of this invention to provide a beach umbrella support stand that may be installed in the sand quickly and conveniently without having to anchor a spike or corkscrew structure in the sand and without having to shovel sand into a weighted container.

It is a further object of this invention to provide a beach umbrella support stand that holds an umbrella securely in place in the sand such that the umbrella resists being blown over by wind gusts that are commonly present on the beach.

It is a further object of this invention to provide a support stand for securely maintaining a variety of support posts upright in a body of sand.

This invention features a beach umbrella support stand including a generally planar platform having an opening formed therethrough. The opening receives an elongate umbrella canopy supporting assembly, which may comprise either a beach umbrella support tube or an umbrella pole. A clamp is mounted to an upper surface of the platform. The clamp is releasably engagable with the elongate umbrella supporting assembly. The clamp is selectively adjusted into a first condition wherein the clamp is closed and engaged with the umbrella supporting assembly to secure the umbrella to the support stand. Alternatively, the clamp is selectively opened to release the elongate umbrella support assembly so that the support member may be selectively removed from and inserted into the opening in the platform. The support stand is set-up at the beach by introducing the platform into the sand such that sand covers and weighs down at least a portion of the platform. The clamp is then opened and the elongate umbrella support assembly is inserted through the opening in the stand. Next, the clamp is closed and engaged with the umbrella support assembly to hold the umbrella in place. As a result, the assembled umbrella extends above the sand and is anchored therein by the support stand.

In a preferred embodiment, the platform has a generally tapered or converging configuration that extends from a relatively wide leading end to a relatively narrow trailing end. The leading end may include a chamfered or beveled surface that permits the planar member to be readily slid below a layer of sand at the beach.

An opening formed proximate the trailing end of the platform forms a handle in the planar member. Typically, the clamp is located adjacent to the opening that defines the handle. The clamp may include a first clamp element that is secured to the planar member and a second clamp element that is adjustably attached to the first clamp element. Means may be provided for interconnecting the first and second clamp elements and adjusting the distance between those elements. For example, the first clamping element may carry a pair of elongate screws, bolts or other threaded components that are fixed to the first clamped element. The threaded element may be received slidably through complementary holes in the second clamp element. A pair of wing nuts or analogous structure may be operably engaged with the threaded components respectively. By tightening the wing nuts on the threaded components, the second clamp member is driven toward the first clamp element and into a closed condition. Alternatively, by loosening the wing nuts on the threaded components, the second clamp element is loosened and opened relative to the first clamp element. Preferably the clamp includes an opening that conforms to the opening formed in the platform. Each clamp element may include a respective recess that forms one half of the opening in the clamp. The clamp opening and the corresponding opening in the planar member may have complementary, generally figure-8 shaped configurations. In particular, each of the openings may include a relatively wide diameter portion for receiving a relatively wide diameter umbrella support and a relatively narrow diameter portion for receiving a relatively narrow diameter umbrella support. By employing this type of structure, the apparatus may be used for various diameters of umbrella poles and tubular umbrella supports.

One or more optional stabilizing wings may be mounted retractably to the platform. Each wing may be pivotably mounted to the platform and alternatable between retracted and extended positions. In the extended position, the wing helps to resist the platform from being lifted by high winds.

DETAILED DESCRIPTION OF PREFERRED EMBODIMENTS

Other objects, features and advantages will occur from the following description of preferred embodiments and the accompanying drawings, in which.

Figure 1:
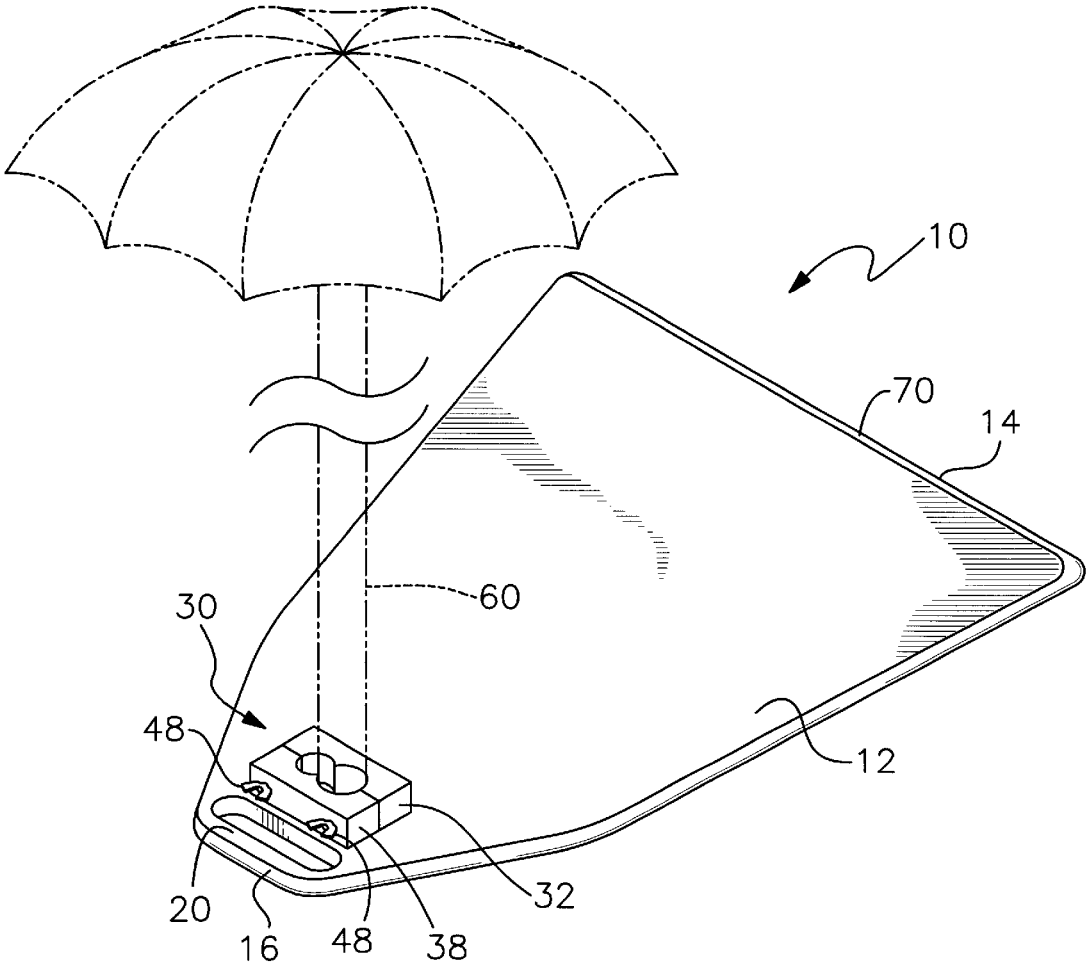
FIG. 1 is a perspective view of the beach umbrella support stand of this invention.

There is shown in FIG. 1 a beach umbrella support stand 10 including a generally planar platform 12. The platform is composed of a rugged, yet lightweight material such as molded plastic or wood. Platform 12 has a preferred thickness of approximately ⅜" although various alternative thicknesses may be utilized. In molded versions, the bottom surface may be recessed to save material and weight. Appropriate reinforcing ribs (not shown) may be formed in the recessed bottom. The platform has a converging or tapered shape extending from a relatively wide leading end 14 to a relatively narrow trailing end 16.

Figure 2:
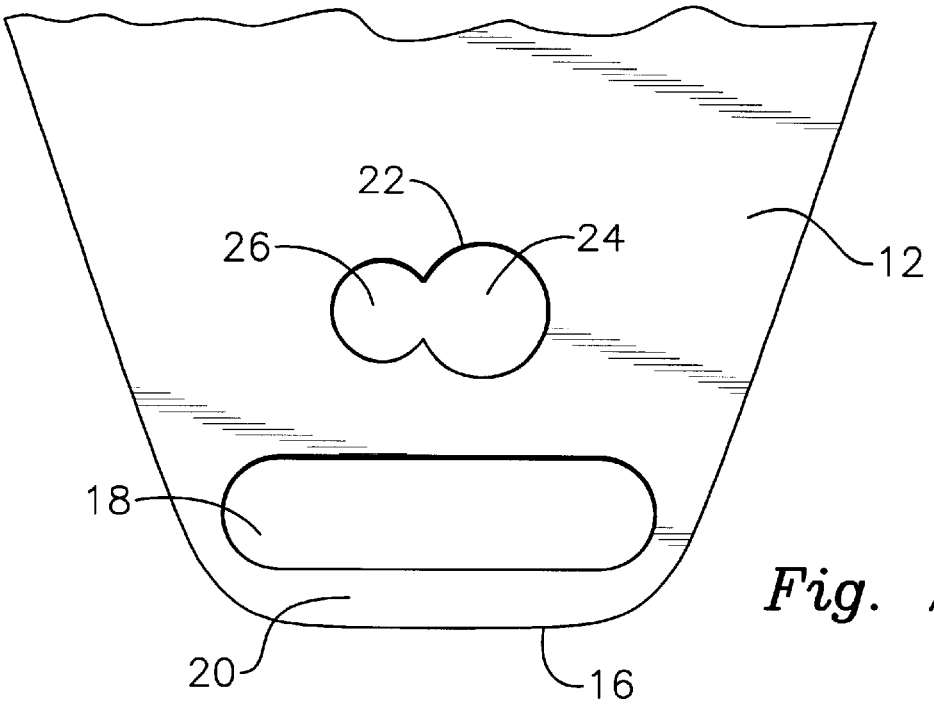
FIG. 2 is a top plan view of the trailing end of the planar platform with the clamp removed.
Figure 3:
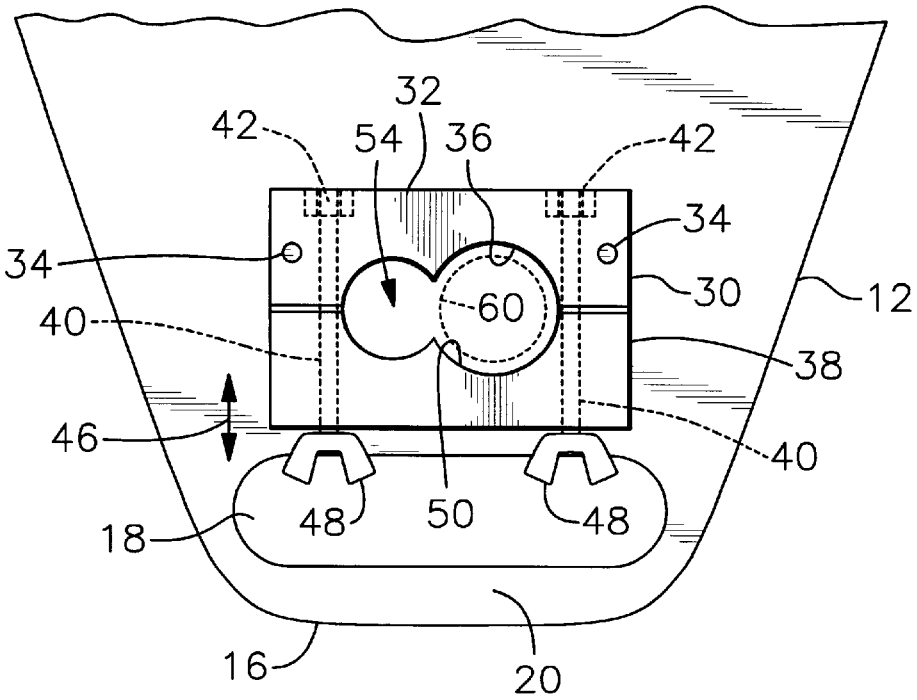
FIG. 3 is a top plan view of the trailing end of the planar platform and the umbrella engaging clamp.

As is further shown in FIGS. 2 and 3, a generally oblong or rectangular opening 18 is formed adjacent to trailing end 16 of platform 12. This opening forms a handle 20 at the trailing end. The user inserts his or her hand through opening 18 and grasps handle 20 so that the support stand 10 may be conveniently transported to and from the beach or other locations.

Figure 8:
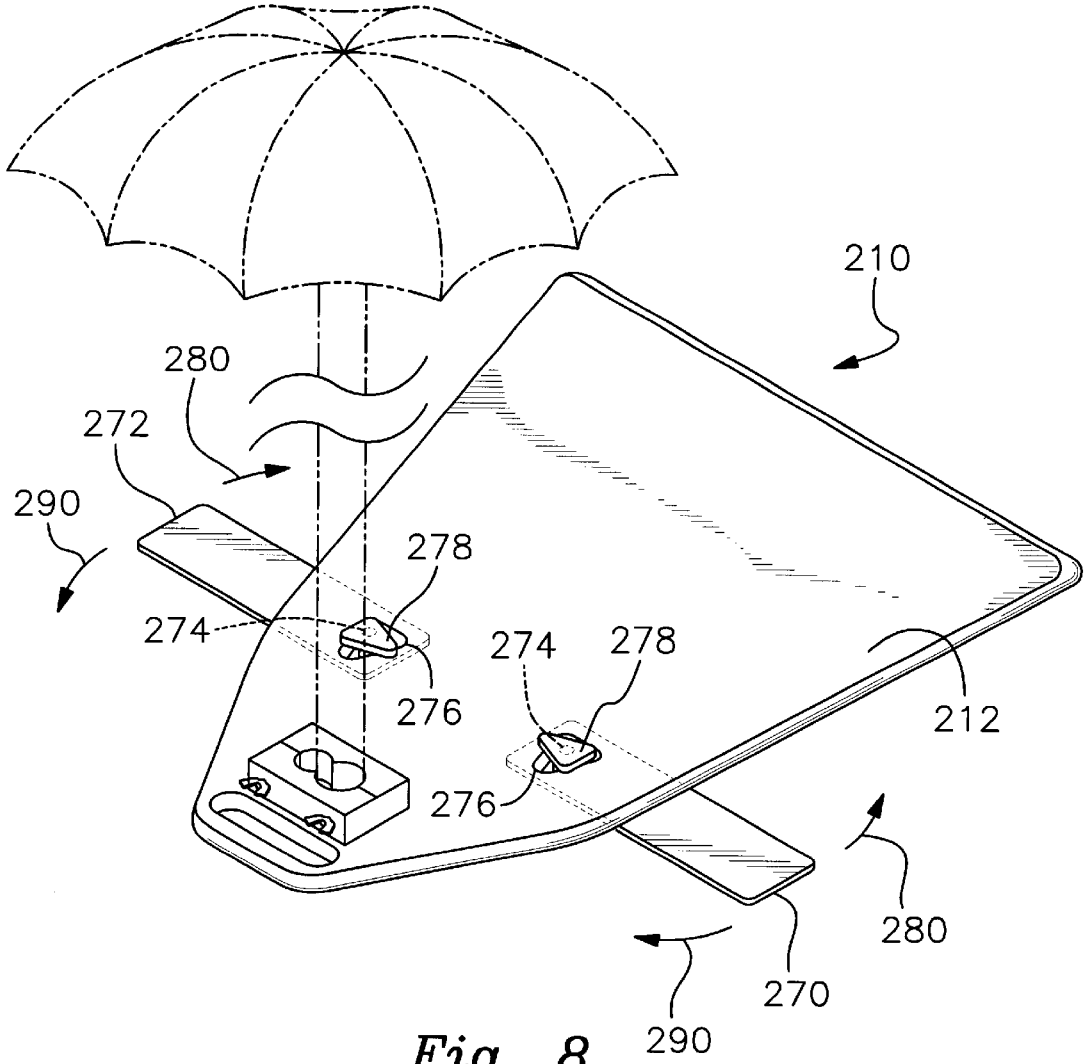
FIG. 8 is a perspective view of a version of the stand utilizing retractable stabilizing wings.

As best shown in FIG. 2, a generally figure-8 shaped opening 22 is formed through platform 12 proximate opening 18. Opening 22 includes a relatively large diameter portion 24 and a relatively small diameter portion 26 formed adjacent to portion 24. Portions 24 and 26 are sized to accommodate elongate umbrella supporting members having various diameters. Such supporting members may comprise, for example, a standard umbrella support tube or a conventional pole or post. A relatively large diameter tube or post is inserted through opening portion 24. A smaller diameter tube or post is inserted through portion 26. This operation is described more fully below.

A clamp 30 is carried by the upper surface of platform 12 in the manner shown in FIGS. 1 and 3. Clamp 30 includes a generally rectilinear first clamping block 32, which is fixed to the upper surface of platform 12 by means such as bolts or pins 34. Alternatively, first clamping block 32 may be secured to the platform by various adhesives. In plastic versions, the first clamping block may be molded integrally with the platform. As best shown in FIG. 3, a leading edge 36 of block 32 includes a curved recess that is shaped somewhat similarly to the number "3".

A second, adjustable clamping block 38 is movably interengaged with block 32. Block 38 again includes a generally rectilinear shape. It also includes a pair of horizontal openings that receive respective threaded bolts 40 carried by first block 32. The heads 42 of bolts 40 are recessed within first block 32 in the manner shown in FIG. 3. Bolts 40 extend across block 32 and are inserted respectively into the horizontal holes formed through block 38. The holes of block 38 have a diameter which is sufficiently large so that block 38 is loosely slidable along bolts 40, as indicated by doubleheaded arrow 46 in FIG. 3. A pair of wing nuts 48 are operably attached to the distal ends of bolts 40. See also FIG. 1. The side of block 38 facing block 32 includes a curved surface 50 that complements the shape of curved surface 36 in block 32. In other words, surface 50 has the shape of a backwards "3".

Wing nuts 48 are selectively tightened and loosened on respective bolts 40 so that the clamping blocks 32 and 38 may be adjusted relative to one another. By tightening the wing nuts against block 38, the blocks are drawn together and clamp 30 is tightened or closed. Conversely, by loosening wing nuts 48, block 38 may be separated from block 32 and the entire clamp 30 is loosened or opened. In the tightened condition, with the clamping blocks snugly interengaging one another, recessed surfaces 36 and 50 define an opening 54, FIG. 3, that has a size and "figure-8" shape virtually identical to those of opening 22 in underlying platform 12.

An umbrella canopy supporting assembly 60 comprising an umbrella pole and/or umbrella supporting tube is inserted into platform 12 and clamped in place in the following manner. Initially, wing nuts 48 are loosened and block 38 is slid along bolts 40 and separated from block 32. Elongate assembly 60, depicted in phantom in FIGS. 1 and 3, is inserted through aligned openings 54 and 22 in clamp 30 and platform 12, respectively. The support assembly 60, which again may comprise a standard umbrella pole or an umbrella support tube, is inserted through either the wide diameter or the narrow diameter portion of the aligned openings 54 and 22. In the embodiment disclosed in the drawings, support assembly 60 is depicted as extending through the wide diameter portions of clamp opening 54 and platform opening 22. Relatively small diameter poles or tubes may be similarly inserted through the aligned small diameter portions of the clamp and platform openings. In either case, after the pole or tube is inserted through the aligned openings, the clamp is tightened by tightening wing nuts 48 on bolts 40. This action draws blocks 38 and 32 together so that the umbrella pole or umbrella support tube is clamped in place within the support stand. The lower end of the support element 60 extends through platform 12. The tightened clamp holds the umbrella securely within the stand. It should be noted that in alternative embodiments, various other types and configurations of clamps and aligned openings may be employed within the scope of this invention.

Figure 4:
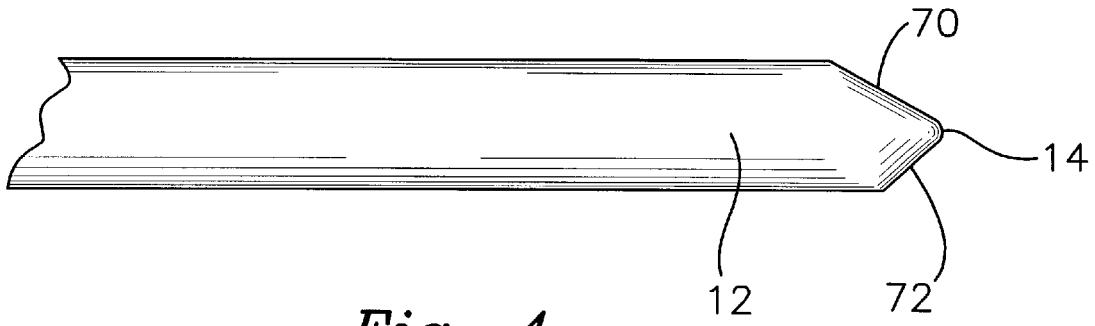
FIG. 4 is an elevational side view of the leading end of the platform.
Figure 5:
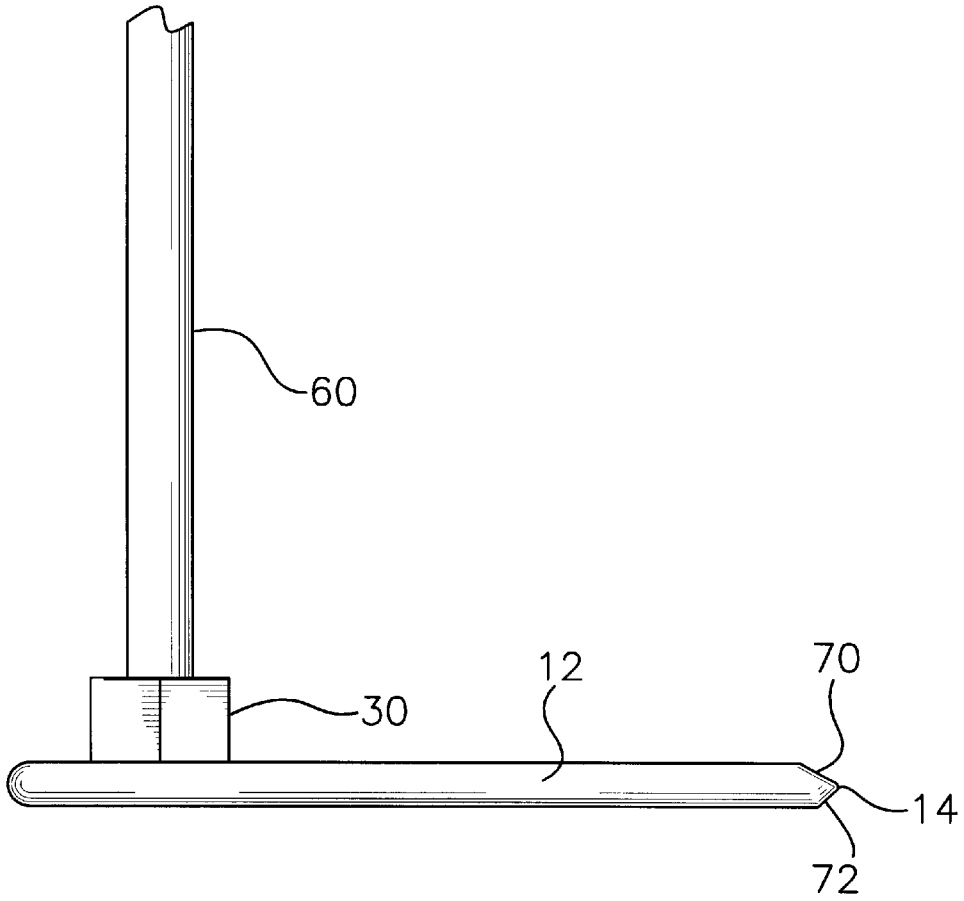
FIG. 5 is an elevational side view of the support stand and an umbrella holder tube engaged by they support stand.

As shown in FIGS. 1, 4 and 5, leading end 14 of platform 12 includes a chamfered upper surface 70 that adjoins the flat upper surface of platform 12. An oppositely chamfered surface 72 interconnects chamfered surface 70 and the flat bottom of platform 12. As a result, platform 12 features a sharp leading end 14. Various other configurations may be employed for providing leading end 14 with a sharp, beveled or otherwise chamfered surface.

Figure 6:
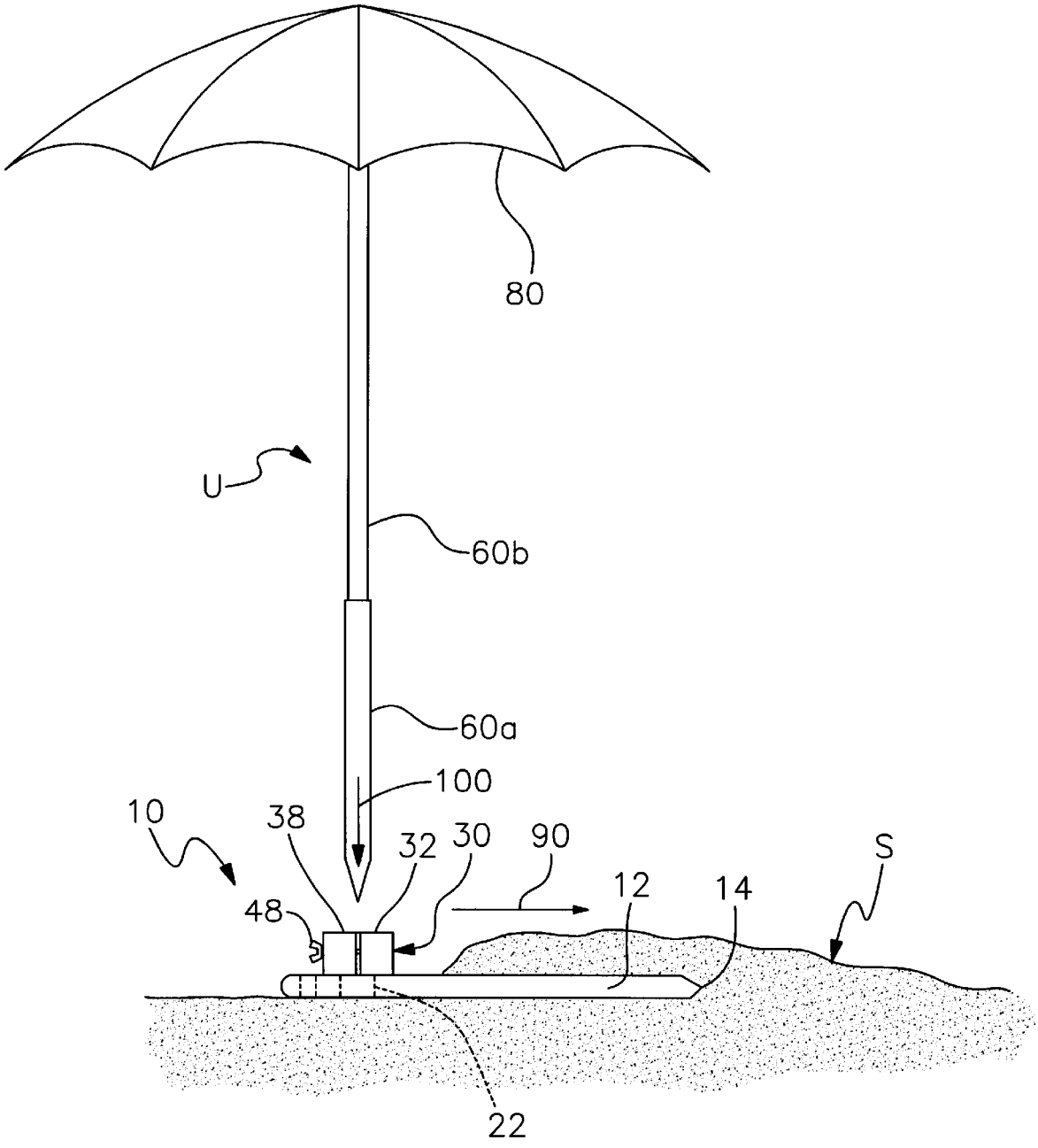
FIG. 6 is an elevational side view of the support stand in use at the beach supporting a conventional beach umbrella.

The umbrella support stand 10 and an attached umbrella structure U are anchored in the sand S in the manner shown in FIG. 6. Stand 10 comprises the elements previously described. Umbrella U includes an elongate support tube 60*a*, an umbrella pole 60*b* that is received by tube 60*a* and a sheet-like canopy 80 that is mounted at the upper end of pole 60*b* in a known manner. Initially, umbrella U is detached from stand 10 and both components are transported by the user to the beach. The umbrella is typically collapsed and carried in a known manner. Support stand 10 is carried by simply grasping handle 20, FIGS. 1 through 3.

After the user arrives at the beach, the umbrella and support stand are deployed. First, stand 10 is anchored into sand S. This is accomplished by simply positioning the chamfered leading end 14 against the sand and sliding platform 12 forwardly into the loose sand, as indicated by arrow 90, FIG. 6. The sharp, chamfered leading end 14 permits the platform to slide relatively easily beneath the sand. The tapered shape of the platform allows the device to act essentially as a shovel which can be quickly, conveniently and almost effortlessly inserted beneath a layer of sand. Additional sand can then be scooped, pushed or otherwise piled onto the upper surface of platform 12. This causes the platform to be set, anchored or planted securely in the sand. Opening 22 is left uncovered by sand so that the umbrella can be installed in the following manner.

After the platform is securely anchored, umbrella U is set up in the stand. Specifically, clamp 30 is opened in the manner previously described. Wing nuts 48 are loosened and clamping blocks 32 and 38 are separated so that the opening 54, FIG. 3, formed between the clamps is wide enough to conveniently receive the pointed lower end of umbrella support tube 60*a*. Umbrella pole 60*b* is inserted into tube 60*a* and the tube is introduced, as indicated by arrow 100, into the space between the clamping blocks 32 and 38. The pointed lower end of tube 60*a* is inserted completely through platform opening 22 and into the sand beneath the platform. Wing nuts 48 are then tightened to draw together clamping blocks 32 and 38. This closes clamp 30 such that it interengages tube 60*a*. The clamp thereby secures umbrella U in place within the support stand 10.

The entire installation procedure is accomplished quickly, conveniently and with virtually no physical effort. The user simply slides the relatively thin platform beneath the sand, inserts the umbrella and clamps it in place. Embedding the platform in the sand is facilitated by the platform's use of chamfered leading end 14. Additional sand, which helps to anchor the umbrella in place, is added on top of the platform by simply pushing the sand onto the platform by hand or with a shovel or other beach implement. Large quantities of sand do not have to be arduously lifted and deposited into a container. Furthermore, the user does not have to struggle inserting a spike or corkscrew structure into soft, shifting or unstable sand. The planar platform utilized by the apparatus significantly facilitates the anchoring of the umbrella. It is particularly easy to pile as much sand as is needed onto the platform so that greater weight is added to the stand and improved stability is achieved.

Stand 10 anchors and supports beach umbrellas and analogous items in a secure and much improved manner. The planar platform is not apt to pull out of soft or shifting sand. The stand is particularly effective in resisting wind gusts that commonly strike beach umbrellas. Normally, such gusts tend to pull standard beach umbrellas out of the sand. The planar shape of platform 12 and the significant weight of the sand that is applied to the platform effectively enable stand 10 to resist the force of the wind and anchor the umbrella much more securely in the sand.

Figure 7:
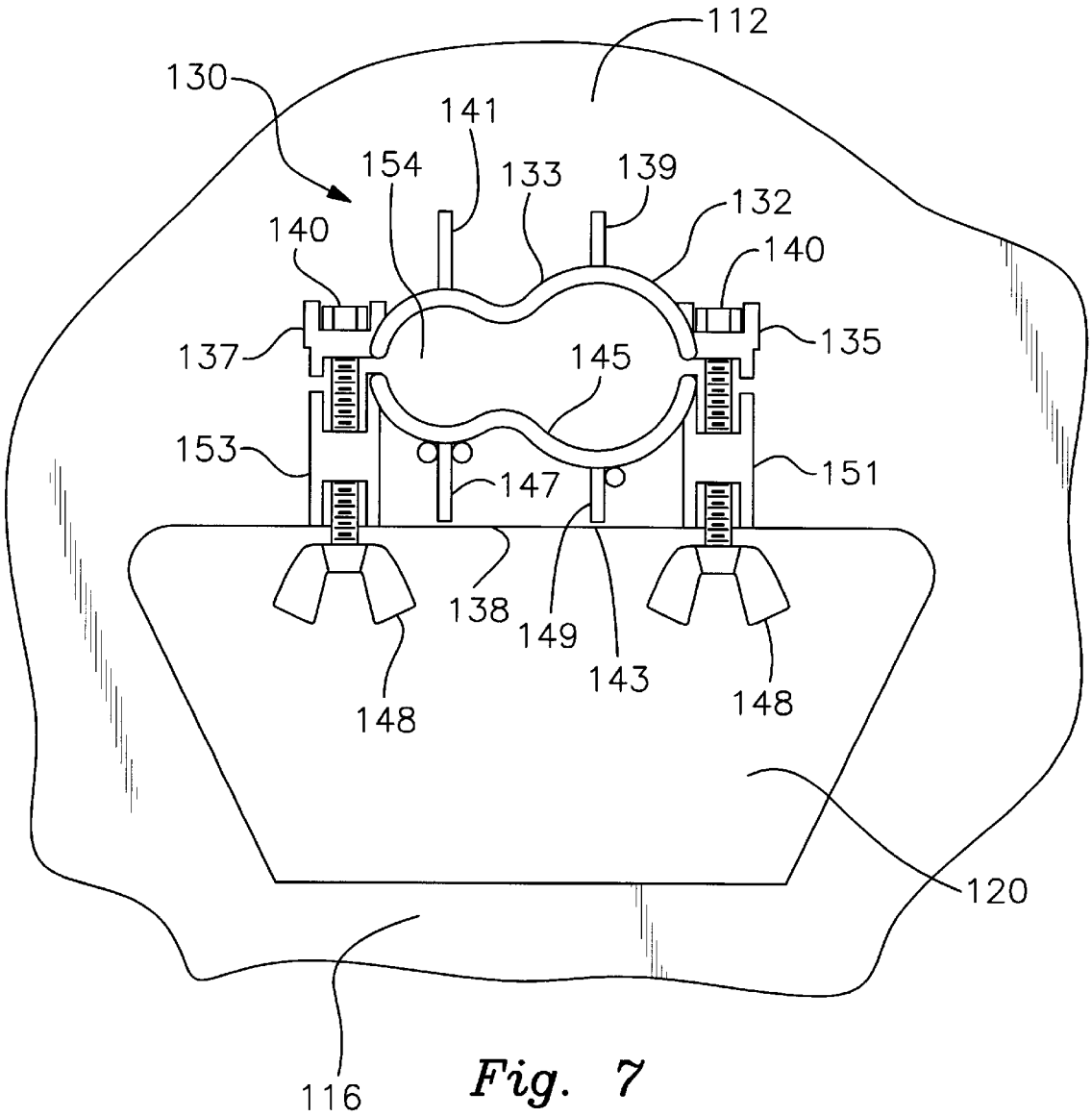
FIG. 7 is an plan view of an alternative preferred molded plastic clamp.

There is shown in FIG. 7 an alternative preferred support stand using a clamp 130 composed of a molded plastic. As in the previous embodiment, clamp 130 is mounted to the upper surface of a platform 112. Only a portion of the platform is shown in FIG. 7. It should be understood that the platform is constructed and configured identically or at least similarly to the platform of the previously described embodiment. Normally, the plastic clamp 130 is used in conjunction with a molded plastic platform 112. The clamp is positioned adjacent to the hole 120 that defines the handle 116 of the platform.

In particular, clamp 130 includes a first clamping piece 132 that is fixedly interconnected to (i.e. molded unitarily with) platform 112. Piece 132 includes a clamping wall 133 that extends upwardly from platform 112 and has a shape generally resembling the number "3". A pair of bolt mounting brackets 135 and 137 are attached to respective ends of wall 133. Each of the brackets 135 and 137 includes an opening (not shown) for receiving a respective bolt 140. A pair of reinforcing ribs 139 and 141 interconnect wall 133 and the upper surface of platform 112.

A second adjustable clamping piece 138 is adjustably attached to clamping piece 132. Piece 138 specifically includes a plate 143 that lays slidably upon the upper surface of platform 112. A second clamping wall 145 having a shape that is symmetrical to wall 133 is attached to and extends upwardly from plate 143. Wall 145 opposes wall 133 and includes a shape resembling the number "3" in reverse. As a result, walls 133 and 145 generally define the shape of figure "8". An opening 154 is formed between the walls. This opening generally conforms to and is aligned with a similarly shaped opening in platform 112. A pair of reinforcing ribs 147 and 149 interconnect wall 145 and the upper surface of plate 143.

Piece 138 also includes a pair of bolt mounting brackets 151 and 153 that are molded unitarily to respective sides of plate 143. Each of brackets 151 and 153 includes a central opening that is aligned with a corresponding central opening in one of brackets 135 and 137, respectively. A first bolt 140 extends through the aligned openings in brackets 135 and 151; a second bolt 140 extends through the aligned openings in brackets 137 and 153. As a result, clamping piece 138 is attached adjustably to clamping piece 132. The slidable clamping piece 138 may be adjusted relative to fixed clamping piece 132 by moving brackets 151 and 153 along respective bolts 140 in a desired direction. This is accomplished by selectively tightening and loosening the wing nuts 148 on the respective bolts 140. By tightening the wing nuts, the bolts draw brackets 151 and 153 toward brackets 135 and 137, respectively. As a result, the clamping walls 145 and 133 are drawn together. This causes the clamping pieces 138 and 132 to engage and hold an umbrella support assembly inserted through opening 154 in the manner previously described. By loosening the wing nuts and sliding piece 138 apart from piece 132, the clamp is released from the support assembly. Accordingly, this embodiment operates analogously to the previously described version.

In the tightened condition, the respective ends of the clamping walls snugly interengage one another so that the walls 133 and 145 clearly define a relatively continuous "figure 8" shape. The opening 154 between the clamping walls substantially conforms to an aligned opening in the underlying platform 112. An umbrella canopy support assembly, comprising a support tube and/or an umbrella pole is inserted through either the wide diameter portion (right-hand side) or the narrow diameter portion (left-hand side) of opening 154 and the aligned opening in the platform. Once again, the size of the opening is selected to accommodate a particular support assembly diameter.

Figure 9:
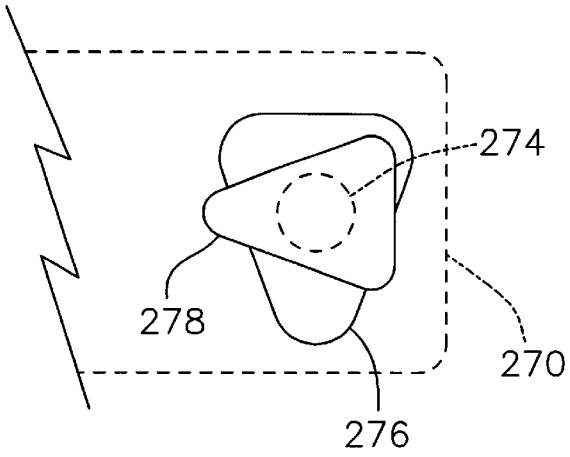
FIGS. 9–11 are plan views of the locking pivot system for interconnecting the stabilizing wing and the platform; the drawings illustrate the wing in extended locked, retracted locked and retracted unlocked conditions respectively.
Figure 10:
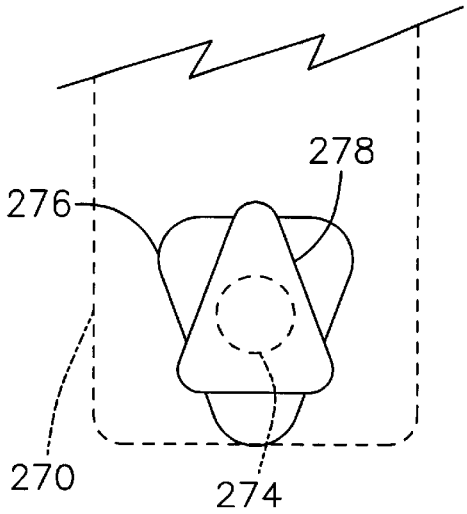
Figure 11:
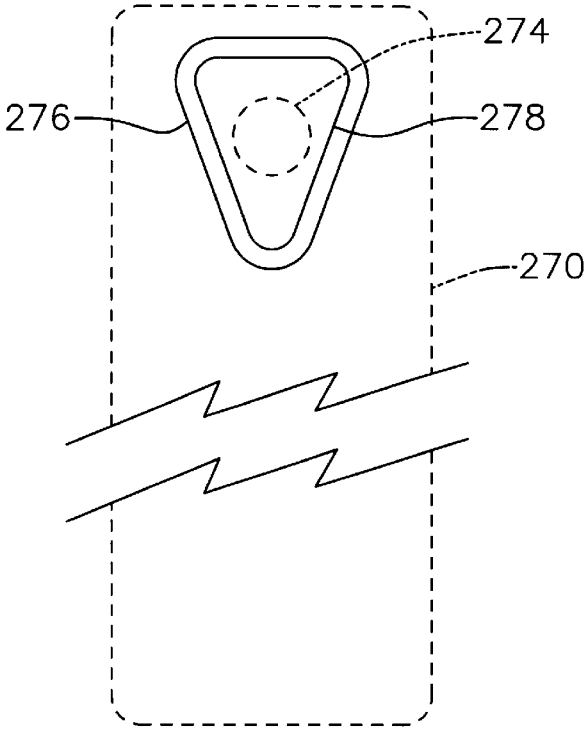

As shown in FIG. 8, an alternative support stand 210 may include a pair of stabilizing wings 270 and 272 that are retractably mounted to platform 212. The platform and clamping assembly are constructed in a manner analogous to the previously described embodiments. Each of the stabilizing wings 270, 272 comprises an elongate, generally flat piece of wood or plastic material that is pivotally or otherwise retractably mounted to the bottom surface of platform 212. A preferred stabilizing wing is approximately 14" long, although this may be varied within the scope of the invention. Each of the wings 270, 272 includes a pivot shaft 274 that extends through a respective hole 276 in platform 212. This hole may have various sizes within the scope of the invention. A generally tear-drop shaped or oblong tab or boss 278, better shown in FIGS. 9–11, is attached to the upper end of each shaft 274. Each of the openings 276 has a similar tear drop or oblong shape.

A representative one of the wings 270 is depicted in various positions in FIGS. 9–11. It should be understood that wing 272 is constructed and operates in a similar manner. During high wind conditions, wing 270 is pivoted outwardly to extend laterally from platform 12. See FIG. 8. In this condition, tab 278 extends across hole 276 such that the tab prevents the wing from being separated from the platform. See FIG. 9. With both wings deployed, the platform is then buried beneath the sand in a manner previously described. The extended wings help to prevent the platform and attached umbrella from being lifted upwardly by high winds.

While the support stand is being transported and at other times that use of the stabilizing wings is not required, the wings may be retracted largely within the periphery of platform 12. This is accomplished by simply pivoting each of the wings 270, 272 beneath the platform as indicated by arrows 280 in FIG. 8. As shown in FIG. 10, tab 278 and its attached wing are pivoted about shaft 274 such that the tear-drop shaped tab and similarly shaped hole 276 face in generally opposite directions. This prevents the tab from being removed through opening 276 and effectively locks the wing to the under side of the platform.

To unlock the wings 270, 272 and remove them from the platform, each wing is pivoted toward the narrow end of the platform as illustrated by arrows 290, FIG. 8. As shown in FIG. 11, each wing is pivoted about shaft 274 until tab 278 is conformably aligned with hole 276 in the platform. As a result, the tab may be pulled through the hole and the wing may be removed from the support stand.

It should be understood that other arrangements and numbers of stabilizing wings may be employed. Alternative means may be used to pivotally or otherwise retractably attach the wings to the platform. The wings may also be mounted to the upper surface of the platform.

The support stand described herein may also be used to anchor various other support posts and beach implements such as volley ball posts. Stand 10 may also be used at sandy locations other than the beach.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A beach umbrella and support stand assembly for use in a body of sand, said assembly comprising:

a canopy;

an elongate member supporting said canopy;

a generally planar platform having an opening formed completely therethrough for receiving said elongate member such that an upper end of said elongate member supports said canopy above said platform and a pointed lower end of said elongate member is beneath said platform; and a clamp mounted to said platform proximate said opening, said clamp being selectively closed to engage and hold said elongate member and opened to release said elongate member;

said platform being introducible beneath and at least partially coverable by the sand and said clamp being closed to hold said elongate member with said lower end of said elongate member beneath said platform and inserted into the sand, whereby said elongate member extends above the body of sand and is anchored therein by said platform and said clamp.

2. The apparatus of claim 1 which said platform has a generally tapered configuration that extends from a relatively wide leading end to a relatively narrow trailing end.

3. The apparatus of claim 2 in which said leading end includes a chamfered surface that permits said platform to be slid below a layer of sand.

4. The apparatus of claim 2 further including a slot formed proximate said trailing end of said platform to form a handle in said platform.

5. The apparatus of claim 4 in which said clamp is located adjacent to said slot.

6. The apparatus of claim 1 which said clamp is mounted on an upper surface of said platform.

7. The apparatus of claim 1 in which said clamp includes an opposing pair of clamp elements, at least one of which is attached to said platform, said clamp elements being adjustably interconnected to each other.

8. The apparatus of claim 7 further including means for interconnecting and adjusting the spacing between said clamp elements.

9. The apparatus of claim 8 in which said means for interconnecting and adjusting include a threaded element attached to a first one of said clamp elements and, interengaging a complementary hole in the other said clamp element and a nut interengaged with said threaded element, said threaded element and said nut being selectively tightened to urge said clamp elements together and close said clamp, said threaded element and nut being loosened to permit said clamp elements to separate and open said clamp.

10. The apparatus of claim 1 which said clamp includes an opposing pair of clamp elements, at least one of which is attached to said platform, said clamp elements being adjustably interconnected to each other and in which said clamp has a recess that conforms with said opening in said platform, at least when said clamp is closed.

11. The apparatus of claim 10 in which each clamp element includes a respective recess segment that forms substantially one-half of said recess in said clamp.

12. The apparatus of claim 10 in which said recess and said opening in said platform have generally conforming, figure-8 shaped configurations.

13. The apparatus of claim 10 in which said recess and said opening define two passageways having different diameters for respectively receiving elongate members with corresponding diameters.

14. The apparatus of claim 1 further including a stabilizing wing and means for retractably mounting the stabilizing wing to said platform such that said wing is alternatable between a retracted condition disposed largely within the perimeter of said platform and an extended condition wherein said wing extends largely outwardly of the perimeter of said platform to stabilize said platform within the body of sand, whereby wind blowing against an umbrella supported by said stand is resisted.

15. The apparatus of claim 6 in which said clamp includes an opposing pair of clamp elements, one said clamp element is fixedly attached to said platform and the other said clamp element is slidably engaged with said platform.

16. An elongate support member and support stand assembly for use in a body of sand, said assembly comprising:

an elongate member for supporting an object above the body of sand;

a generally planar platform having an opening formed completely therethrough for receiving said elongate member such that a lower end of said elongate member is beneath said platform; and a clamp mounted to said platform proximate said opening, said clamp being selectively closed to engage and hold said elongate member and opened to release said elongate member;

said platform being introducible beneath and at least partially coverable by the sand and said clamp being closed to hold said elongate member with said lower end of said elongate member beneath said platform and inserted into the sand, whereby said elongate member extends above the body of sand and is anchored therein by said platform and said clamp.

17. A support stand for securing a beach umbrella in a body of sand, which umbrella includes a canopy and an elongate canopy supporting assembly, said stand comprising:

a generally planar platform having an opening formed therethrough for receiving the elongate canopy supporting assembly; and a clamp mounted to said platform proximate said opening, said clamp being selectively closed to engage and hold a canopy supporting assembly received by said opening and opened to release the canopy supporting assembly;

said clamp having a recess that conforms with said opening in said platform, at least when said clamp is closed, said recess and said opening having generally conforming, figure-8 shaped configurations;

said platform being introduced beneath and at least partially covered by the sand and said clamp being closed to hold a canopy supporting assembly received by said opening, whereby the beach umbrella extends above the body of sand and is anchored therein by said support stand.

18. A support stand for securing a beach umbrella in a body of sand, which umbrella includes a canopy and an elongate canopy supporting assembly, said stand comprising:

a generally planar platform having an opening formed therethrough for receiving the elongate canopy supporting assembly; and a clamp mounted to said platform proximate said opening, said clamp being selectively closed to engage and hold a canopy supporting assembly received by said opening and opened to release the canopy supporting assembly;

said platform being introduced beneath and at least partially covered by the sand and said clamp being closed to hold a canopy supporting assembly received by said opening, whereby the beach umbrella extends above the body of sand and is anchored therein by said support stand;

said stand further including a stabilizing wing and means for retractably mounting the stabilizing wing to said platform such that said wing is alternatable between a retracted condition disposed largely within the perimeter of said platform and an extended condition wherein said wing extends largely outwardly of the perimeter of said platform to stabilize said platform within the body of sand, whereby wind blowing against an umbrella supported by said stand is resisted.

19. The apparatus of claim 18 in which said stabilizing wing is pivotally mounted to said platform.

20. A support stand for securing a beach umbrella in a body of sand, which umbrella includes a canopy and an elongate canopy supporting assembly, said stand comprising:

a generally planar platform having an opening formed therethrough for receiving the elongate canopy supporting assembly; and a clamp mounted to said platform proximate said opening, said clamp being selectively closed to engage and hold a canopy supporting assembly received by said opening and opened to release the canopy supporting assembly;

said platform being introduced beneath and at least partially covered by the sand and said clamp being closed to hold a canopy supporting assembly received by said opening, whereby the beach umbrella extends above the body of sand and is anchored therein by said support stand;

said clamp having a recess that conforms with said opening in said platform, at least when said clamp is closed, said recess and said opening in said platform defining two passageways having different diameters for respectively receiving elongate members with corresponding diameters.

* * * * *